US007214041B2

(12) United States Patent
Birch et al.

(10) Patent No.: US 7,214,041 B2
(45) Date of Patent: May 8, 2007

(54) SEAL ASSEMBLIES

(75) Inventors: Peter Hugh Birch, Horsham (GB); David Alan Turrell, Burgess Hill (GB); Malcolm William Gray, Crawley (GB); Neil Turner, Godalming (GB)

(73) Assignee: The BOC Group plc, Windlesham, Surry (GB)

( * ) Notice: Subject to any disclaimer, the term of this patent is extended or adjusted under 35 U.S.C. 154(b) by 45 days.

(21) Appl. No.: 10/555,972

(22) PCT Filed: May 6, 2004

(86) PCT No.: PCT/GB2004/001955

§ 371 (c)(1),
(2), (4) Date: Nov. 8, 2005

(87) PCT Pub. No.: WO2004/099620

PCT Pub. Date: Nov. 18, 2004

(65) Prior Publication Data

US 2006/0216186 A1 Sep. 28, 2006

(30) Foreign Application Priority Data

May 8, 2003 (GB) ..... 0310615.0

(51) Int. Cl.
*F03C 2/00* (2006.01)
*F04C 2/00* (2006.01)

(52) U.S. Cl. ..... 418/9; 418/15; 418/126; 418/149; 418/189; 418/206.1; 418/206.6

(58) Field of Classification Search ..... 418/5, 418/8, 9, 15, 126, 149, 189, 190, 206.1, 206.6
See application file for complete search history.

(56) References Cited

U.S. PATENT DOCUMENTS

| | | | | | |
|---|---|---|---|---|---|
| 4,789,314 | A | * | 12/1988 | Higuchi et al. | 418/9 |
| 4,990,069 | A | * | 2/1991 | Guittet et al. | 418/9 |
| 5,173,041 | A | * | 12/1992 | Niimura et al. | 418/9 |
| 5,567,140 | A | * | 10/1996 | Dodd | 418/178 |
| 5,816,782 | A | * | 10/1998 | Nagayama et al. | 418/9 |
| 6,123,526 | A | * | 9/2000 | Chen et al. | 418/9 |
| 6,572,351 | B2 | * | 6/2003 | Durand et al. | 418/9 |
| 2002/0155014 | A1 | * | 10/2002 | Durand et al. | 418/9 |

FOREIGN PATENT DOCUMENTS

| | | | |
|---|---|---|---|
| GB | 356168 | A * | 12/1930 |
| JP | 04050492 | A * | 2/1992 |

* cited by examiner

*Primary Examiner*—Theresa Trieu
(74) *Attorney, Agent, or Firm*—Ira Lee Zebrak

(57) ABSTRACT

A seal assembly for the protection of a static seal device for use in a vacuum pump. The seal assembly comprising at least two components which are sealingly connected together, an o-ring seal, which is engaged between the two components to prevent transfer of fluid to and from the pump between these two components and a fluid channel. The fluid channel being in the plane of the o-ring and located between the o-ring seal and a process gas flow path. The fluid channel provides a path for a barrier gas to be routed when the apparatus is in use. The channel being connectable to an external source of barrier fluid and having an outlet in fluid communication with the pump swept volume.

6 Claims, 3 Drawing Sheets

SEAL ASSEMBLIES

FIELD OF THE INVENTION

This invention relates to seal assemblies. In particular, seal assemblies used in vacuum pumps and, more particularly, in multi-stage, oil free (dry) vacuum pumps.

BACKGROUND OF THE INVENTION

Vacuum pumps are known which are oil-free in their vacuum chambers and which are therefore useful in clean environments such as those found in the semiconductor industry. In such a manufacturing environment, if lubricants were present in the vacuum chambers, these materials could potentially back migrate into the process chamber and, in so doing, may cause contamination of the product being manufactured. Such dry vacuum pumps are commonly multi-stage positive displacement pumps employing intermeshing rotors in each vacuum chamber. The rotors may have the same type of profile in each chamber or the profile may change from chamber to chamber.

In either a Roots or Northey ("claw") type device, each chamber is typically formed from two separate machined stator components with the rotor components being located in the cavity formed there between. It is necessary to provide a sealing means between the two stator components in order to prevent leakage of the process gas from the pump and to prevent any ambient air from entering the pump. An o-ring is typically provided to perform this sealing function. However, given the harsh corrosive nature of the process gases these o-rings are readily attacked and need to be replaced frequently, thus causing costly servicing down times for the entire process. Furthermore, the contact surfaces of the stator can experience corrosion, which can lead to anomalies in these surfaces such that distortion of the pump case can occur. This distortion leads to a reduction in clearance between rotating and static components that, in turn, can affect the mechanical reliability of the pump.

Conventional systems are known which introduce mechanical barriers to protect the static sealing mechanism by preventing some of the hazardous/corrosive gaseous material from reaching the o-ring component. However, compatibility must be achieved between the material chosen to form this mechanical barrier and the process gas. Furthermore, additional complexity is introduced into the system by the presence of such a mechanical barrier and such a mechanical barrier will not generally protect the contact faces of the stators.

The present invention aims at overcoming the aforementioned problems by providing an alternative, simple means for protecting the sealing mechanism and the contacting stator faces.

BRIEF SUMMARY OF THE INVENTION

According to the present invention there is provided a seal assembly for the protection of a static seal device for use in a vacuum pump, the seal assembly comprising:

at least two components to be sealingly connected together;

an o-ring seal, engaged between the two components to prevent transfer of fluid to and from the pump between these two components; and a fluid channel in the plane of the o-ring and located between the o-ring seal and a process gas flow path, wherein the channel has a configuration to provide, in use, a path for a barrier fluid to be routed and the channel has an inlet connectable to an external source of barrier fluid and an outlet in fluid communication with a swept volume of the pump.

The fluid channel may be provided in one or both of the stator components and may comprise lateral channels to enhance radial leakage towards the cavity. The o-ring seal may be made from an elastomeric material and it may be located within the fluid channel. A vacuum pump comprising a plurality of stator components maybe provided where, each pair of stator components are positioned in relation to one another to provide a cavity therbetween. Process gases may pass through this cavity in use. A seal assembly of the invention may be included for providing a fluid tight seal between adjacent stator components.

BRIEF DESCRIPTION OF THE DRAWINGS

An example of the present invention will now be described with reference to the accompanying drawings, in which.

DETAILED DESCRIPTION OF THE INVENTION

Figure 1:
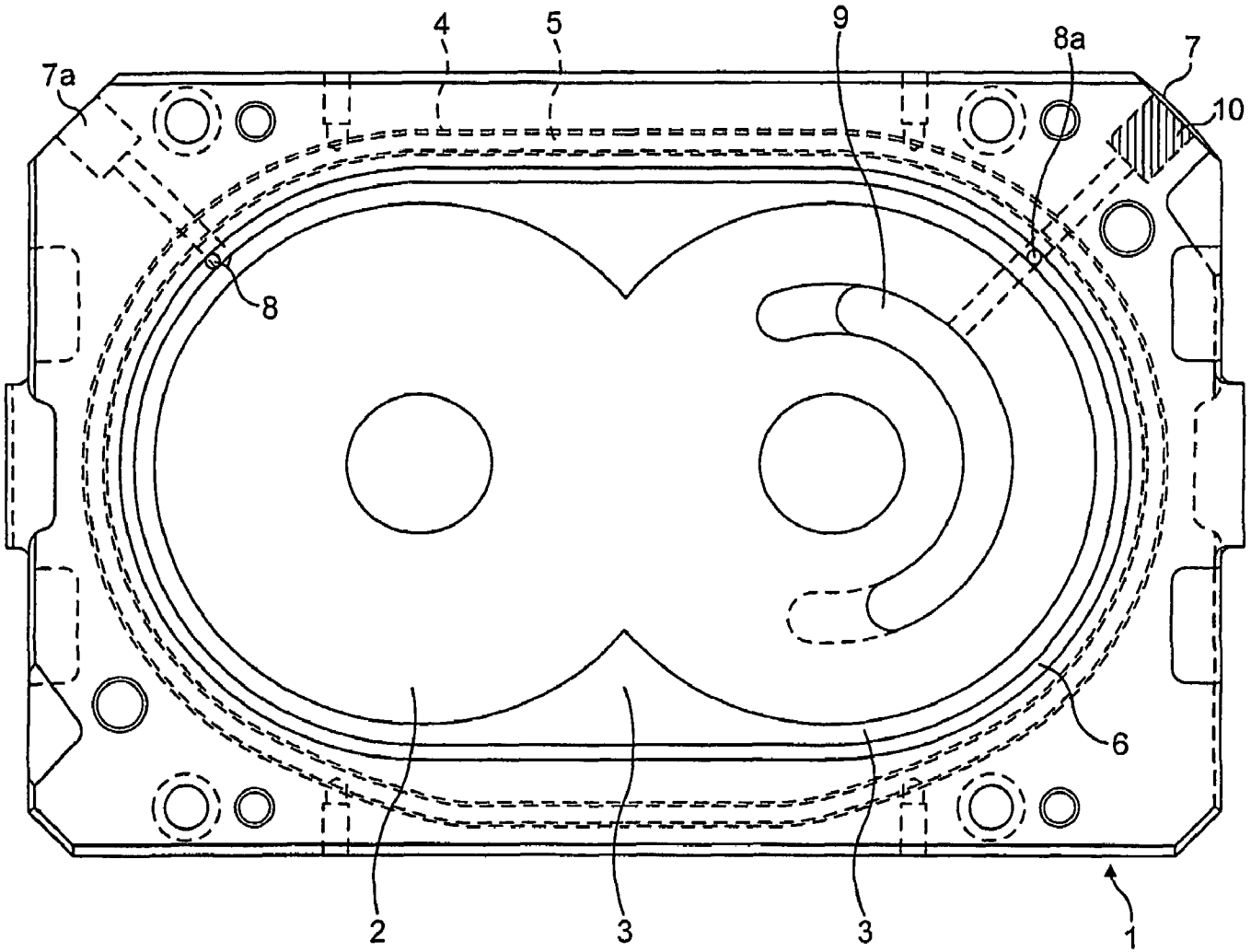
FIG. 1 is a front view of a stator component showing components of an example of the invention.

FIG. 1 illustrates the surface of a stator component 1 from one stage of a dry pump. A surface of a second stator component (not shown) is brought into contact with the corresponding surface 3 of the first stator component 1 and a cavity 2 is formed between these components. This cavity 2 is provided to accommodate the rotor component (not shown) when the pump is assembled. Such a pump typically comprises several such stages, the cavity 2 of each stage communicating with the next stage through an interstage aperture 9.

As in conventional pumps of this type, an o-ring seal 4 is provided around the periphery of the cavity. This seal 4 provides a fluid tight seal between adjacent stator components such that process gases are prevented from escaping from the cavity 2 and ambient air is prevented from entering the cavity when the pump is in use. However, these process gases can be particularly aggressive and readily cause damage to both the o-ring seal 4 and the contacting surfaces 3 of the stator components.

In this example of the present invention the o-ring 4 is made of an elastomeric material and is located within a groove 5. This groove is machined in the surface 3 of the stator component. An additional channel 6 is formed in the contact surface 3 of the stator component 1. This channel 6 is located between the o-ring groove 5 and the cavity 2 through which, in use, process gases will pass.

A pump is typically supplied with a purge gas, this gas being chosen to be unreactive under the given conditions, such as Nitrogen. This purge gas serves to dilute the process gases in the pump to maintain the partial pressure of the process gas below the saturated value at which condensation may start to form. It is desirable to prevent such condensation as this may lead to corrosion of pump components or, alternatively, may lead to deposits being formed within the clearances between the rotor and the stator components. Such effects lead to a reduction in pump reliability as tolerances can be affected and, in an extreme case, seizure may occur, especially during restart of the pump after some shut down. In some pumps such a purge gas is introduced directly into the cavity 2 through purge fluid inlet 7 via the interstage aperture 9 (as illustrated in FIG. 1) to mix with the process gases. This purge gas is typically at an elevated pressure to the process gases and, therefore, passes into the cavity 2 without undue resistance.

In the present invention this conventional purge fluid inlet 7 is blocked using a plug 10 (as shown in FIG. 1) and an alternative purge fluid inlet 7*a* is provided. The elevated pressure purge gas passes through aperture 8, in use, to the fluid channel 6 to act as a barrier gas. The barrier gas travels around the fluid channel 6 in both directions and exits the channel via aperture 8*a* into the interstage 9 to perform the conventional purge function within the pumping mechanism. In use, this barrier gas travels around the channel 6 and provides an obstacle to minimise the level of process gas reaching the o-ring seal 4. The elevated pressure of this barrier gas ensures that the small, anticipated level of leakage that occurs from the barrier gas channel 6 has a tendency to pass from the channel towards the cavity 2. Since the barrier gas and the purge gas are the same material from the same source, the impact of this leakage on the performance of the pump is negligible.

The pressure gradient between the barrier gas and the process gas will further inhibit the process gas from coming into contact with the o-ring seal 4. If, however, some transient condition is experienced, the favourable pressure gradient may not be maintained. In such a situation some process gas may come into contact with the o-ring seal 4. In these conditions, the barrier gas will serve to dilute the potentially corrosive process fluid such that its harmful impact on the o-ring seal 4 is significantly reduced. Furthermore, if such conditions do arise, whereby the protected area becomes contaminated, the barrier gas will flush the area clean once the transient condition is removed.

Figure 2A:
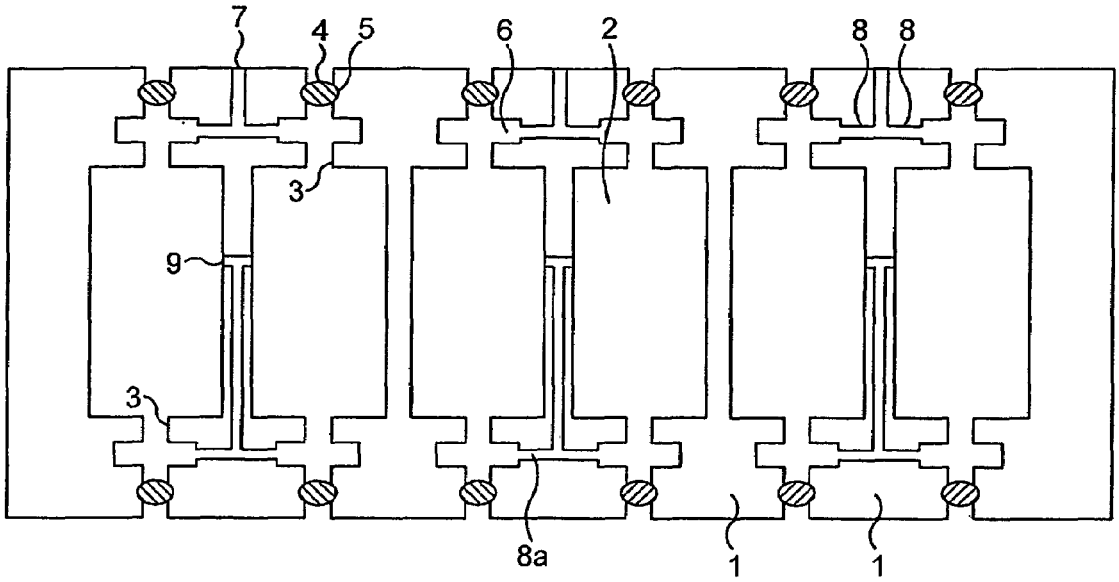
FIG. 2 are side views schematics of different examples of the present invention.

FIG. 2*a* shows a section of a pump according to the present invention. This figure illustrates how multiple stator sections 1 are positioned adjacent to each other to form a series of cavities 2. The elastomeric seal 4 is located in groove 5 to provide a fluid tight seal. The channel 6 is positioned radially inwards of the seal 4 in order to provide the protective layer between the cavity 2 and the seal 4 and to allow purge gas to flush the region between contact surfaces 3, in use.

Figure 2B:
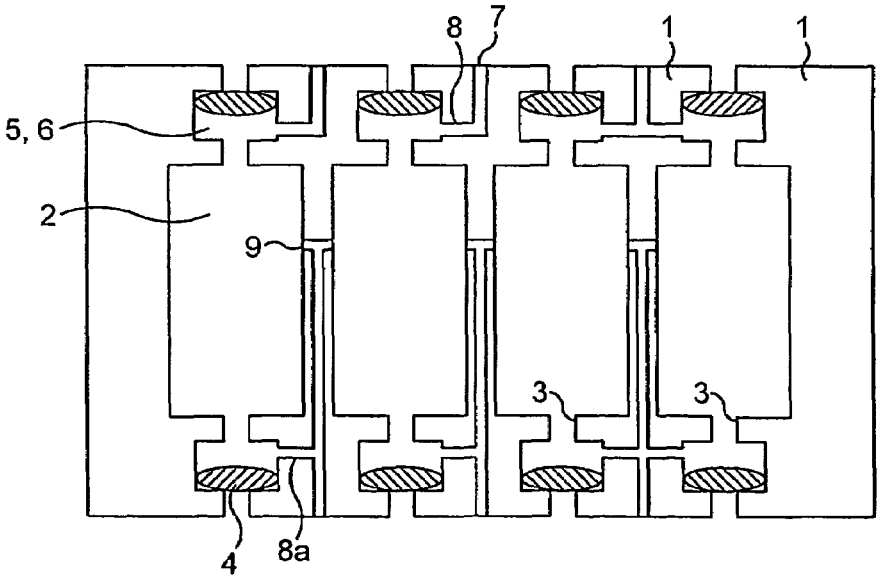

In an alternative example of the present invention the channel 6 and the groove 5 could be combined in a single feature such that the channel, accommodates both the barrier gas and the o-ring seal 4, as illustrated in FIG. 2*b*.

There is a requirement for the materials used in the fabrication of the mechanical barrier of the conventional sealing means to be suited to the particular aggressive process gases that are likely to be encountered by that pump. By using an unreactive gas barrier as provided by the present invention, a greater range of compatibility with different process gases can be achieved such that this selection function is simplified. Furthermore, whereas the pump would need to be dismantled to change the mechanical barrier to one of a different composition, it is straightforward to substitute an alternative compatible purge/barrier gas if a different process is to be undertaken. Indeed, this flexibility can be used to greater advantage in diverse processes where a range of potentially incompatible materials is to be used that may require switching to an alternative purge gas. Since the purge gas also acts as the barrier gas the selection of materials has already been performed and can, therefore, be regarded as compatible.

Since conventional mechanical barriers are attacked by aggressive process gases, the conventional barrier has a limited service life. Replacement of these barriers and seals leads to costly disruption of the manufacturing process. However, the barrier gas of the present invention is constantly replenished and thus does not contribute to the servicing interval of the pumping apparatus.

A further advantage of the present invention is in protecting the contacting surfaces of adjacent stator components. When these, generally metal, surfaces come into contact with the aggressive process gases, corrosion will occur. Since the corrosion product occupies a bigger volume than the original metal, the metal surfaces swell as they corrode. This increase in volume forces adjacent stator components to separate from each other. When viewed from the side (as in FIG. 2), assume that one of the outer stator components is fixed in relation to the pump housing. If such corrosion occurs, the adjacent stator component will move away from the first stator component along an axis perpendicular to the contacting surfaces. If this corrosion occurs at all such contacting faces the displacement experienced by each subsequent stator component will be compounded. Consequently, the stators that are remote from the first fixed stator component move more than those that are close to it, due to the effects of this corrosion. As the stator components are displaced, the cavities 2 formed between these components also shift away from the initial fixed stator component. However, the rotor components do not move in relation to this original fixed stator location. This has the effect of relatively displacing any single rotor component to one side of the associated cavity, such that the axial clearance between a rotor component and its adjacent stator components becomes unbalanced. In extreme circumstances, the clearance between a rotor component and its associated stator component may reduce to zero such that the two components make contact. The possibility of such a scenario arising may be increased during restart of a pump after a shut down period.

Figure 3:
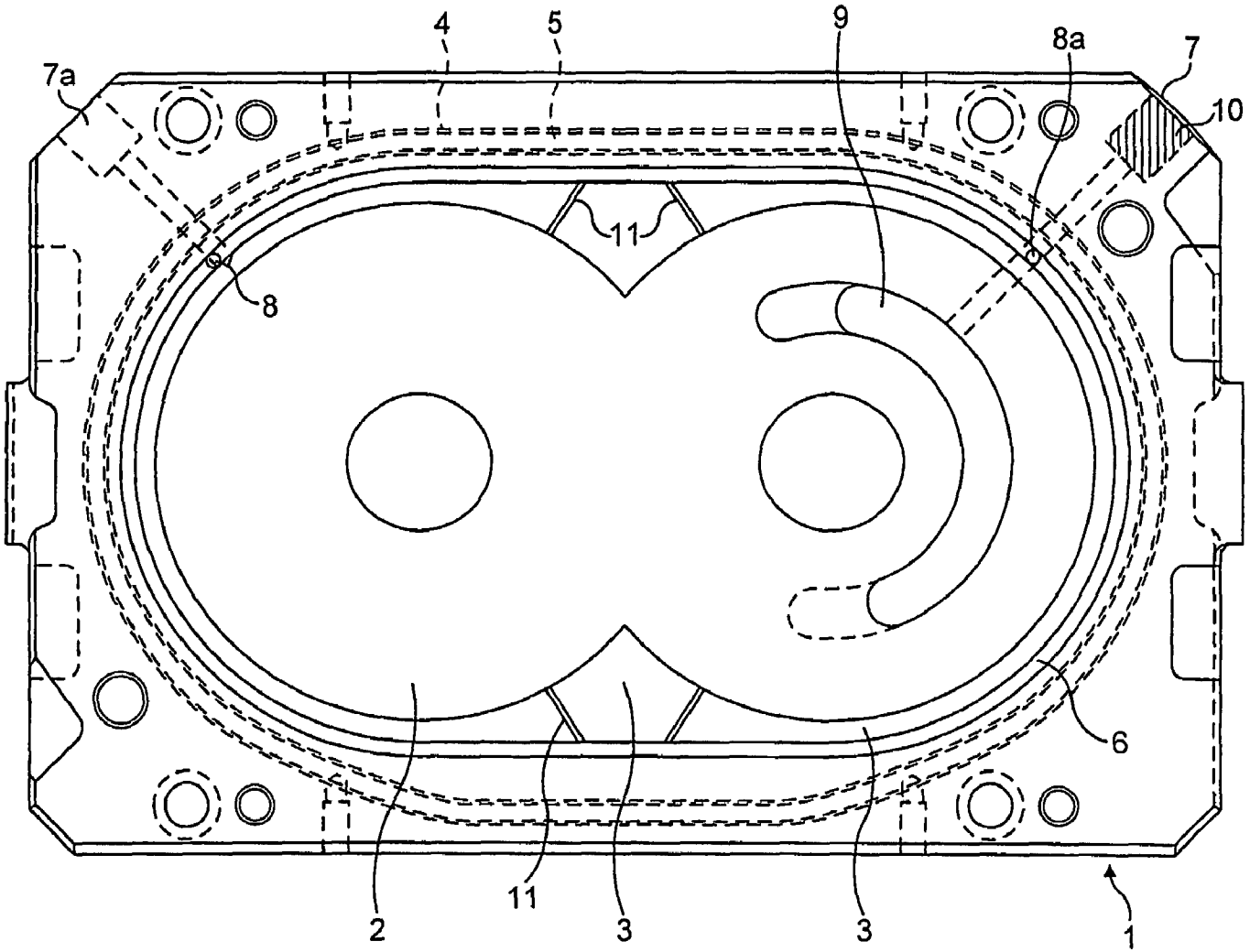
FIG. 3 illustrates a further example of the present invention.

A conventional mechanical barrier is positioned so as to protect the elastomeric seal and does not give any protection to the contacting surfaces of adjacent stator components. Leakage of some of the barrier gas used to protect the elastomeric seal in the present invention occurs across these contacting faces, indeed as illustrated in FIG. 3 the channel 6 can be further modified by the introduction of lateral grooves or channels 11, for example, to encourage such leakage. The presence of the barrier gas in this area, between the contacting surfaces, effectively reduces the concentration of aggressive process gas in this area thereby reducing the level of corrosion of these contact surfaces and, consequently, increasing pump reliability/life.

In exceptionally harsh environments where the process gases are particularly aggressive the present invention may be combined, in series, with conventional mechanical barrier devices or further gas barriers to further improve the protection of the o-ring seal.

We claim:

1. A seal assembly for the protection of a static seal device for use in a vacuum pump, the seal assembly comprising:

at least two stator components to be sealingly connected together;

an o-ring seal, engaged between the two components to prevent transfer of fluid to and from the pump between these two components; and a fluid channel in the plane of the o-ring and located between the o-ring seal and a process gas flow path, wherein the channel has a configuration to provide, in use, a path for a barrier fluid to be routed and the channel has an inlet connectable to an external source of barrier fluid and an outlet in fluid communication with a swept volume of the pump.

2. The seal assembly according to claim 1, wherein the fluid channel is provided in at least one of the stator components.

3. The seal assembly according to claim 1, wherein the o-ring seal is made from an elastomeric material.

4. The seal assembly according to claim 1, wherein the o-ring seal is located in the fluid channel.

5. The seal assembly according to claim 1, wherein the fluid channel further comprises lateral channels to encourage leakage of a barrier gas towards the cavity.

6. A vacuum pump comprising a plurality of stator components, each pair of stator components being positioned in relation to one another to provide a cavity therebetween through which process gases pass and a seal assembly according to claim 1 for providing a fluid tight seal between adjacent stator components.

* * * * *